US007303507B1

(12) United States Patent
Jozsa

(10) Patent No.: US 7,303,507 B1
(45) Date of Patent: Dec. 4, 2007

(54) FOREARM-MOUNTED, ADJUSTABLE EXERCISE DEVICE

(76) Inventor: Timothy J. Jozsa, 16641 Tower Ct., Tinley Park, IL (US) 60477

( * ) Notice: Subject to any disclaimer, the term of this patent is extended or adjusted under 35 U.S.C. 154(b) by 605 days.

(21) Appl. No.: 10/713,389

(22) Filed: Nov. 14, 2003

(51) Int. Cl.
*A63B 23/16* (2006.01)
*A63B 15/00* (2006.01)
*A63B 21/06* (2006.01)

(52) U.S. Cl. ..... 482/50; 482/109; 482/93

(58) Field of Classification Search ..... 482/44–50, 482/93–97, 106–107
See application file for complete search history.

(56) References Cited

U.S. PATENT DOCUMENTS

| | | | | |
|---|---|---|---|---|
| 2,617,650 | A | 11/1952 | Landis | |
| 3,042,023 | A * | 7/1962 | Yates | 601/33 |
| 4,039,183 | A | 8/1977 | Sakurada | |
| 4,109,908 | A | 8/1978 | Pugh et al. | |
| 4,231,569 | A | 11/1980 | Rae | |
| 4,345,756 | A | 8/1982 | Hoagland | |
| 4,589,655 | A * | 5/1986 | Ammon | 482/46 |
| 4,607,840 | A * | 8/1986 | Harper | 482/109 |
| 4,943,052 | A * | 7/1990 | Powers | 482/108 |
| 4,964,631 | A * | 10/1990 | Marano | 482/93 |
| 5,281,192 | A | 1/1994 | Nelson | |
| 5,350,345 | A | 9/1994 | Frey | |
| 5,435,800 | A | 7/1995 | Nelson | |
| 6,213,921 | B1 | 4/2001 | Frey | |
| 6,340,341 | B1 * | 1/2002 | Purcell | 482/108 |
| 6,572,515 | B2 | 6/2003 | De La Garza | |

* cited by examiner

*Primary Examiner*—Fenn C. Mathew
(74) *Attorney, Agent, or Firm*—Andrus, Sceales, Starke & Sawall, LLP

(57) ABSTRACT

A forearm-mounted exercise device has a framework provided with a weight supporting bar and a handgrip on a first portion of the framework, and a pair of spaced apart forearm braces on a second portion of the framework. A rotary adjustment arrangement is incorporated in the framework for enabling rotational positioning between the first portion of the framework and the second portion of the framework. A forearm brace adjustment arrangement is disposed on the framework for changing the spacing between the forearm braces on the second portion of the framework.

17 Claims, 4 Drawing Sheets

FIG. 1
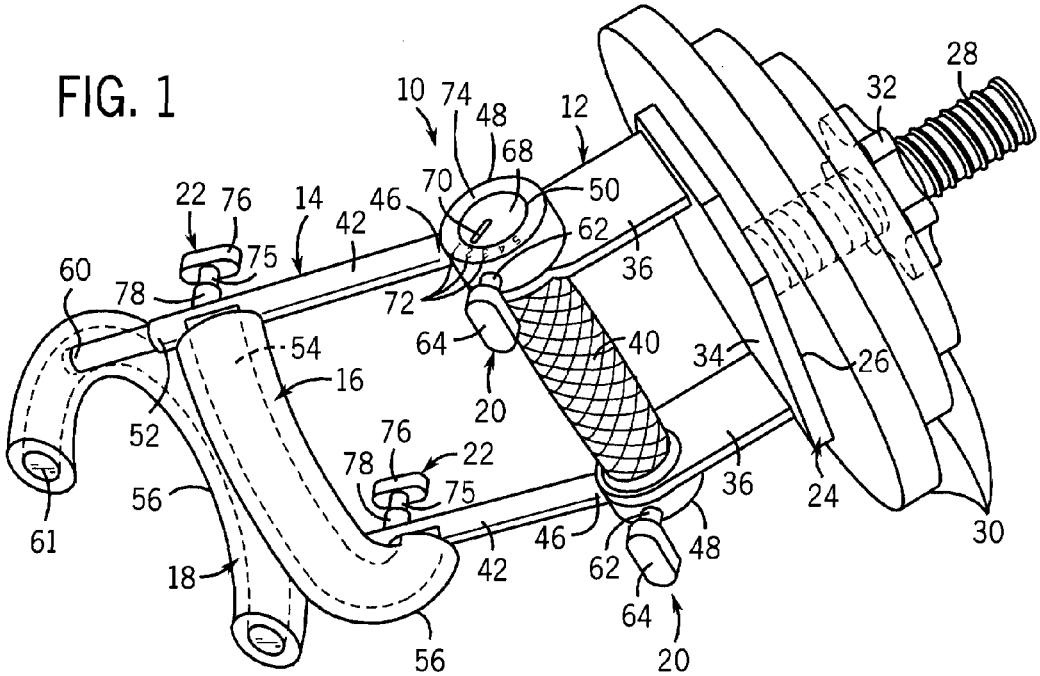
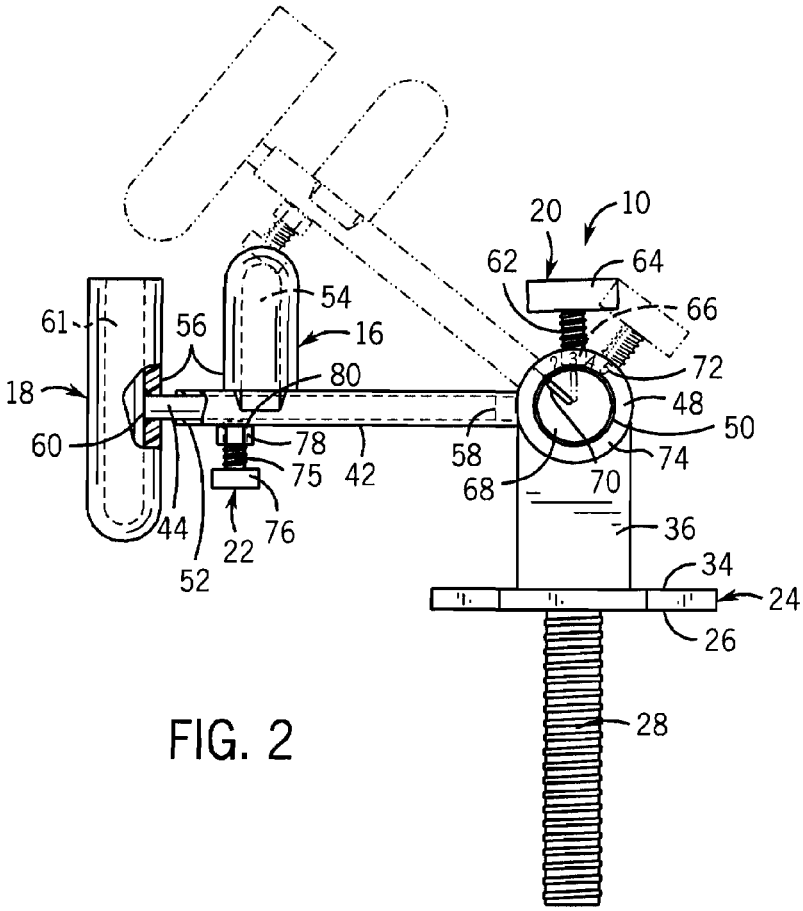
FIG. 2

FIG. 5
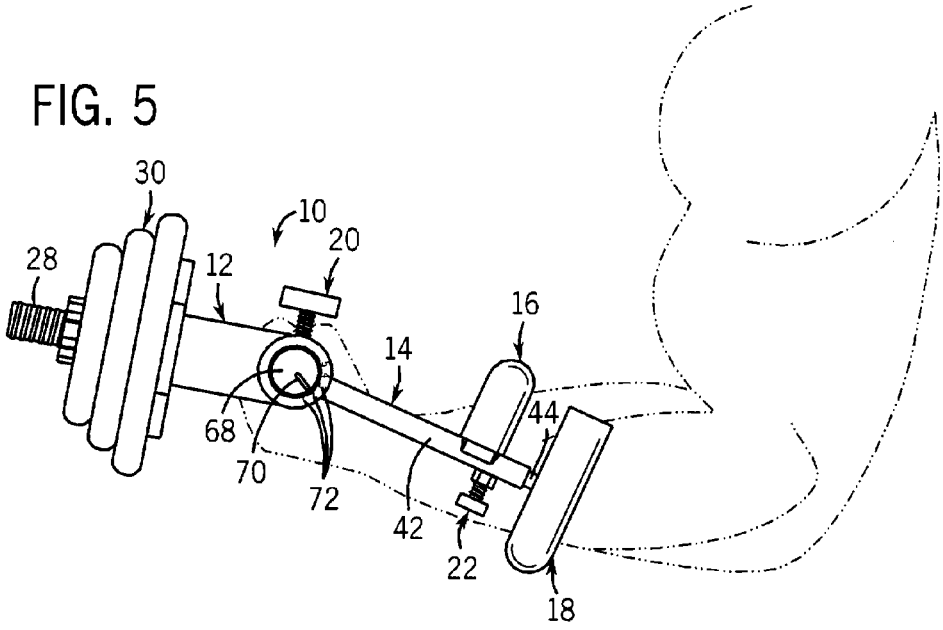
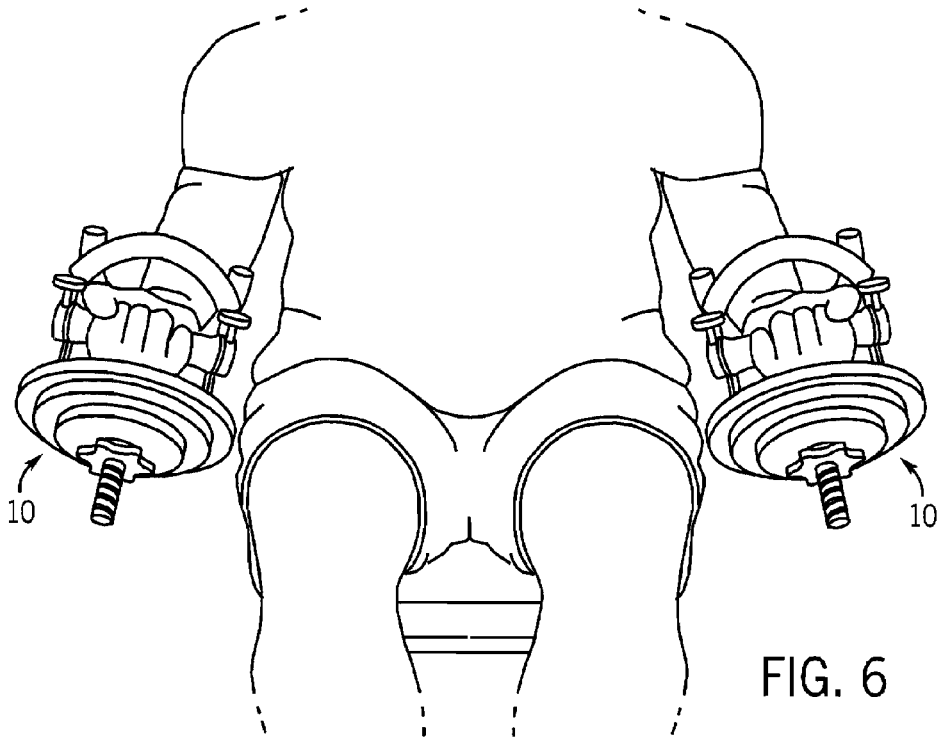
FIG. 6

FOREARM-MOUNTED, ADJUSTABLE EXERCISE DEVICE

FIELD OF THE INVENTION

The present invention relates generally to exercise devices implemented in weight training and, more particularly, pertains to a forearm-mounted exercise device which is variously adjustable and used to efficiently perform a variety of muscle-building exercises.

BACKGROUND OF THE INVENTION

In the classic form of isotonic training, free weights on dumbbells or barbells are raised and lowered along a curved path about some axis. The axis itself passes through some joint of the body such as the elbow or shoulder. A deficiency of some weightlifting exercises exists in that when the weight is directly above or below the axis, very little torque is being exerted about the axis, and accordingly, at these certain positions, the muscles are exerting little effort even though the primary muscles being exercised may still be capable of exerting a strong force at these points.

An example of the type of exercise referred to above is a curling movement for the biceps muscle on the front of the upper arm. In performing a curl, as a weight is lifted from a lower position with a user's arm extended downwardly to an upper position where the arm is bent at the elbow, a moment created about the elbow is continually reduced as the weight is lifted to the upper position. Thus, substantially less bicep effort is needed to hold the weight near or in the upper position resulting in the biceps becoming unstressed almost in a rest period. Over time, any accumulated rest periods will detract from the effectiveness of the exercise so that the muscular development is impeded.

Over the years, efforts have been made to provide isokinetic devices which strive to at least maintain the level of resistance applied to a muscle over a fuller range of the exercise. One such device is disclosed in U.S. Pat. No. 4,231,569 to Rae issued Nov. 4, 1980. Rae discloses a device that is used to extend the standard bar or dumbbell weight outwardly of the user's forearm to increase the leverage produced by the weight. This device includes a triangular frame for carrying the weight, a handgrip and a forearm brace at corners of the triangle configuration. The user's forearm will come into contact with the brace only through some portions of arcuate movement of the user's arm. The weights swing freely through the remainder of arm motion with the forearm brace disengaged from the user's forearm. The effect with the weight hanging freely is no different than the effect experienced with ordinary dumbbells.

U.S. Pat. No. 4,607,840 to Harper issued Aug. 26, 1986 discloses yet another weight training apparatus in the form of a frame, a handgrip and a bar for mounting weights outward of the handgrip. First and second braces are also provided towards the rearward end of the frame and extend in opposite directions relative to the plane of the frame. These braces engage opposite sides of the user's forearm so that weight training plates can be mounted at an extended distance beyond the hands of the user in order to apply selective leverage against the user's arm. A portion of the frame is telescopically adjustable so as to vary the distance between the handgrip and an axis of the bar.

U.S. Pat. No. 4,943,052 issued Jul. 24, 1990 to Powers shows an exercising barbell provided with a rigid frame having gripping, support and weight portions spaced apart and oriented such that the center of gravity of the barbell is spaced from both the gripping and support portions. The gripping portion is suited to be gripped by an exerciser's hand, and the support portion is suited then to cooperate with a part of the exerciser's body spaced from the gripping hand. Straps for a support portion may be looped around and secured in a loop fashion to hold the support portion to the spaced part of the exerciser's body. This forms a two-point support of the barbell relative to the exerciser, to allow the exerciser to move the barbell vertically between lower and upper portions in the course of the exercise whereby the muscles of the exerciser must be stressed.

Nothing in the prior art, however, provides an exercise device which maintains resistance throughout a full range of movement while also offering a variable angular adjustment of the weights relative to a framework supported on one's forearm. In addition, there is no capability shown in the prior art for providing variable spacing between a pair of forearm braces attached to the framework.

SUMMARY OF THE INVENTION

It is one object of the present invention to provide a forearm-mounted exercise device which enables continuous stress to be applied to a muscle during an entire exercise movement so as to maximize the degree of muscular development thereof.

It is also an object of the present invention to provide a forearm-mounted exercise device wherein a second brace-equipped framework is angularly adjustable relative to a first framework for supporting weights thereon.

It is a further object of the present invention to provide a weight-loaded, exercise device wherein a telescopic framework enables variable spacing of a pair of braces used to support the exercise device on one's forearm.

In one aspect of the invention, a forearm-mounted exercise device has a framework provided with a weight supporting bar and a handgrip on a first portion of the framework, and a pair of spaced apart forearm braces on a second portion of the framework. The invention is improved by a rotary adjustment arrangement incorporated in the framework for enabling variable rotational positioning between the first portion of the framework and the second portion of the framework. The second portion of the framework is rotatably mounted on the handgrip. A rotary locking arrangement is engageable with the handgrip for selectively locking and unlocking the first and second portions of the framework in various angular positions on the handgrip.

In another aspect of the invention a forearm-mounted exercise device has a framework provided with a weight supporting bar and a handgrip on a first portion of the framework, and a pair of spaced apart forearm braces on a second portion of the framework. The invention is further improved by a forearm brace adjustment arrangement disposed on the framework for changing the spacing between the forearm braces on the second portion of the framework. The second portion of the framework includes a first pair of elongated, parallel first tubular members rotatably secured to the handgrip for carrying one of the forearm braces, and a second pair of elongated, parallel tubular members slidably received within the first pair of tubular members for mounting the other of the forearm braces. A locking arrangement is provided on the first pair of tubular members for selectively locking and unlocking the second pair of tubular members at various linear positions relative to the first pair of tubular members.

In yet another aspect of the invention, an exercise device is adapted to be supportively fixed over a user's forearm and gripped by a hand thereon for mounting at least one weight plate outward of the hand to maintain the resistance applied by the weight plate over a full range of different exercises. The device includes a first framework having one end provided with a weight receiving and supporting bar, and an opposite end mounting a handgrip thereon. A second framework is pivotally secured to the handgrip. A first brace is joined to the second framework and is adapted to engage a top surface of the user's forearm. A second brace is connected to the second framework in spaced relationship to the first brace and is adapted to engage a bottom surface of the user's forearm. A locking arrangement is located between the first framework and the second framework for selectively locking and unlocking the first framework and the second framework together at various relative angular positions on the handgrip.

The second framework is constructed and arranged such that the spacing between the first brace and the second brace is adjustable. The first framework includes a support base having a forward surface mounting the weight receiving and supporting bar therefrom, and a rearward surface connected to a pair of rearwardly extending, spaced apart, support arms engaged with respective opposite ends of the handgrip such that the opposite ends of the handgrip extend laterally from the support arms. The weight receiving and supporting bar projects outwardly from the forward surface of the support base in substantially perpendicular relationship thereto. The second framework includes a first pair of elongated, parallel tubular members having first ends rotatably mounted to the laterally extending opposite ends of the handgrip, and open second ends, the first brace being fixed to the first tubular members adjacent the second ends thereof. The first ends of the first pair of tubular members are provided with ringed collars rotatably engaged with cylindrical portions on the opposite ends of the handgrip. The opposite ends of the handgrip are provided with indicators and the ringed collars are provided with indicia cooperable with the indicators for indicating the various relative angular positions of the first and second frameworks relative to one another. The second framework also includes a second pair of elongated, parallel tubular members having first ends slidably received in the open second ends of the first pair of tubular members, and second ends connected to the second brace. The locking arrangement includes a pair of locking screws screwthreaded into the ringed collars and engaged against the opposite ends of the handgrip. Another locking arrangement is located on the first tubular members adjacent the second end thereof for selectively locking and unlocking the second pair of tubular members in various linear positions relative to the first pair of tubular members. The latter locking arrangement includes another pair of locking screws screwthreaded into the first pair of tubular members for engagement against the second pair of tubular members. The second framework is rotationally adjustable relative to the first framework between a first angle at which the longitudinal axes of the second tubular members are perpendicular to the longitudinal axis of the weight receiving and supporting bar, and a second angle at which the longitudinal axes of the second tubular members are parallel to the longitudinal axis of the weight receiving and supporting bar.

Still another aspect of the invention relates to an exercise device adapted to be supportively fitted over a user's forearm and gripped by a hand thereon for mounting at least one weight plate outward of the hand to maintain the resistance applied by the weight plate during various exercises. The device includes a fixed framework having one end provided with a weight receiving and supporting spindle, and an opposite end mounting a handgrip thereon. A telescopic framework is pivotally secured to the handgrip and includes a first pair of elongated, spaced apart tubular members having first ends rotatably mounted to opposite ends of the handgrip, and open second ends. The telescopic framework also includes a second pair of elongated, spaced apart tubular members having first ends slidably received in the open second ends of the first pair of tubular members, and second ends projecting in a direction away from the handgrip. A first brace is joined to the first pair of tubular members adjacent the second ends thereof and is adapted to engage a top surface of the user's forearm. A second brace is fixed to the second pair of tubular members adjacent the second end thereof and is adapted to engage a bottom surface of the user's forearm. A first locking arrangement is located on the first ends of the first pair of tubular members for selectively locking and unlocking the first and second pairs of tubular members in various angular positions on the handgrip. A second locking arrangement is positioned on the first pair of tubular members adjacent the second ends thereof for selectively locking and unlocking the second pair of tubular members in various linear positions longitudinally relative to the first pair of tubular members so that the first brace and second brace are variably spaced from one another. The distance between the weight receiving and supporting spindle and the handgrip is fixed.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a perspective view of a weight-loaded, forearm-mounted, adjustable exercise device embodying the present invention;

FIG. 2 is an elevational view of the exercise device of FIG. 1 without the weights installed thereon, showing a first operational position in full lines and a second operational position in phantom lines;

FIG. 5 is a side elevational view of the exercise device applied to the forearm of an exerciser performing bicep curls;

FIG. 6 is the front view of a pair of exercise devices applied to the forearms of an exerciser performing bicep curls.

DETAILED DESCRIPTION OF THE INVENTION

Figure 3:
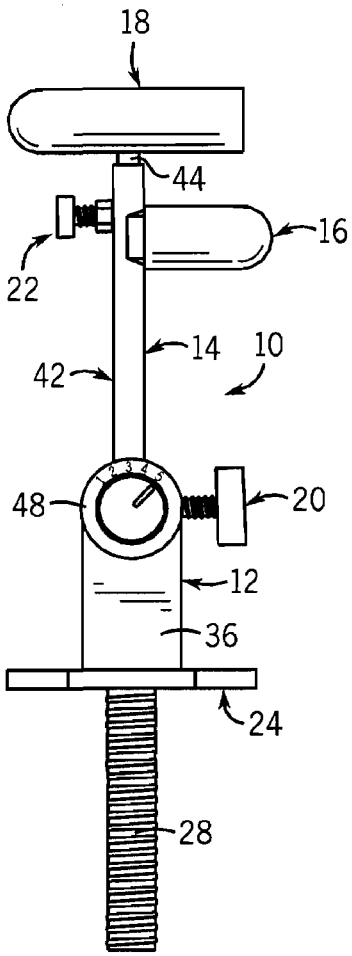
FIG. 3 is a view like FIG. 2 showing the exercise device in a third operational position.
Figure 4:
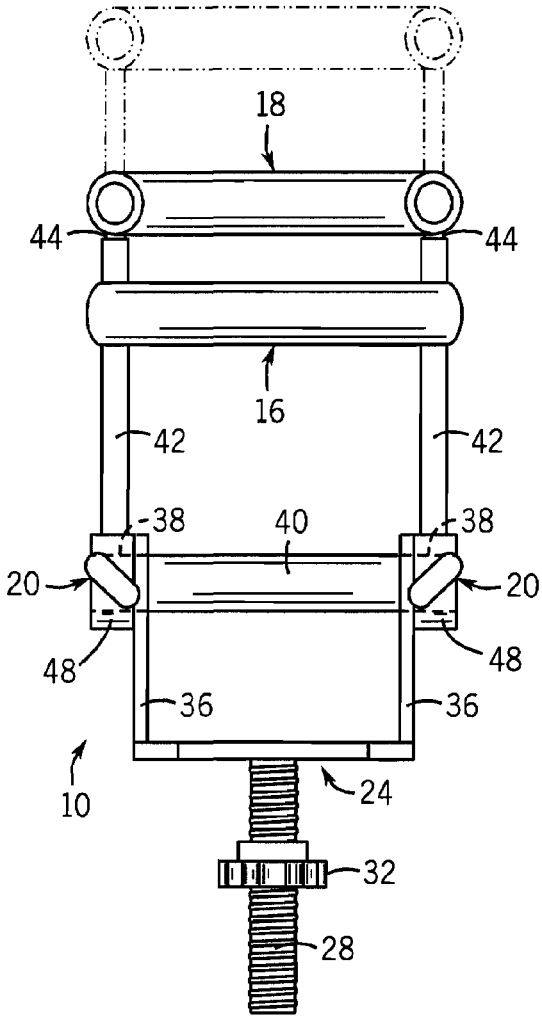
FIG. 4 is a plan view of the exercise device as taken from the right side of FIG. 3, showing a further operational position in phantom lines.

Referring now to FIGS. 1-4, there is shown an adjustable exercise device 10 adapted to be mounted on the forearm of an exerciser or user and grasped in one's hand to perform various muscle-building exercises.

As seen in FIG. 1, the exercise device 10 is comprised of a first or fixed framework 12, a second or telescopic framework 14, a first forearm brace 16, a second forearm brace 18, a first locking arrangement 20 and second locking arrangement 22.

The first or fixed framework 12 includes a planar support base 24 having a forward surface 26 mounting a weight receiving and supporting bar or spindle 28 therefrom. In the illustrated embodiment, the bar 28 projects outwardly and perpendicularly from the forward surface 26, and is typically externally threaded and sized preferably to receive and hold at least one and, in this case, three apertured weight plates 30 thereon. An internally threaded collar or retainer 32 is spun onto the bar 28 to maintain the weight plates 30 in fixed position between the forward surface 26 and a face of the retainer 32. It should be understood that the bar 28 may be otherwise formed and oriented, such as a two-ended bar that is fixed across the forward surface 26 in which case weight plates 30 could be suitably retained on each end of the bar. The support base 24 also has a rearward surface 34 connected to a pair of rearwardly extending, spaced apart, parallel support arms 36. The rear portions of the support arms 36 encircle and are fixed to opposite ends 38 (FIG. 4) of a generally cylindrical, knurled handgrip 40. The opposite ends 38 of the handgrip 40 extend laterally from the sides of the support arms 36. The support arms 36 establish a fixed distance between the handgrip 40 and the support base 24 supporting the weight plates 30.

The second or telescopic framework 14 is rigid and is pivotally and adjustably secured to the handgrip 40. The framework 14 includes a first pair of elongated, spaced apart, parallel tubular members 42 and a second pair of elongated, spaced apart parallel tubular members 44 which are slidably adjustable relative to tubular members 42. The first pair of tubular members 42 has first ends 46 provided with ringed collars 48 having interior surfaces 50 which are rotatably engaged with outer cylindrical portions on the opposite ends 38 of the handgrip 40. The first pair of tubular members 42 also has second ends 52 which are open for receiving the second pair of tubular members 44. The first forearm brace 16 is a rigid, curved, U-shaped element 54 having opposed ends which are fixed, such as by welding, to the first pair of tubular members 42 adjacent the second ends 52 thereof. The first forearm brace 16 is provided with an external resilient, protective covering 56 along the entire length thereof. The second pair of tubular members 44 has first ends 58 (FIG. 2) slidably or telescopically received in the open second ends 52 of the tubular members 42, and second ends 60 fixedly connected to medial portions of the second forearm brace 18. The second brace 18 is a rigid, curved, U-shaped element 61 which is also provided with an external, resilient, protective covering 56. As will be understood below, the respective curvatures of the forearm braces 16, 18 are oppositely oriented so as to engage different top and bottom surfaces of one's forearm during use of the exercise device 10.

At this point, it should be realized that the pivotal mounting of the ringed collars 48 on the handgrip ends 38 defines a rotary adjustment means for enabling variable rotational positioning between the first or fixed framework 12 and the second or telescopic framework 14. In addition, the telescopic relationship between the tubular members 42, 44 creates a forearm brace adjustment means for changing the spacing between the first and second forearm braces 16, 18.

The first locking arrangement 20 is engageable with the handgrip 40 for selectively locking and unlocking the first and second frameworks 12, 14 in various relative angular positions. The locking arrangement 20 includes a pair of adjustable locking screws 62 having oval-shaped turning heads 64 integral therewith. The locking screws 62 are screwthreaded into holes 66 (FIG. 2) formed in the outer surfaces of the ringed collars 48. The holes 66 extend entirely through the ringed collars 48 so that the locking screws 62 can engage outer peripheral surfaces of the handgrip opposite ends 38. With this structure, a desired angular position of the second framework 14 can be locked on the handgrip 40 relative to the fixed or first framework 12 so as to position the weight plates 30 at various angles in relation to a user's forearm.

In order to establish the various relative angular positions maintained by the first locking arrangement 20, outer faces 68 on the opposite ends 38 of the handgrip 40 are provided with fixed indicators 70. The indicators 70 are cooperable with indicia, such as several numerical settings 72, formed on rotatable outer faces 74 of the ringed collars 48. In the preferred embodiment, the second framework 14 is designed to be angularly positioned between a 90 degree angle (FIG. 2) wherein the longitudinal axes of the second tubular members 44 are perpendicular to the longitudinal axis of the bar 28, and a 180 degree angle (FIGS. 3 and 4) wherein the longitudinal axes of the tubular members 44 are parallel to the longitudinal axis of the bar 28. Three other intermediate angular settings 72 are provided, two of which are illustrated in FIG. 1 in full lines and FIG. 2 in phantom lines. While five numerical settings 72 are shown in the drawings, it should be understood that more or less angular settings can be provided as desired.

The second locking arrangement 22 is provided for selectively locking and unlocking the second pair of tubular members 44 in various linear positions relative to the first pair of tubular members 42. The locking arrangement 22 includes a pair of adjustable locking screws 75 having oval-shaped turning heads 76 integral therewith. The locking screws 75 are screwthreaded into spaced apart nuts 78 fixed on the tubular members 42 and pass through aligned apertures 80 (FIG. 2) in the tubular members 42 for engagement with the outer peripheral surfaces of the tubular members 44. As a result of this construction, the spacing between the forearm braces 16, 18 may be selectively varied as exemplified in FIG. 4. This feature allows the exercise device 10 to be used on forearms and different limb lengths and to provide different comfort levels of the worn device 10 as the braces 16, 18 engage different locations on the user's forearm.

Figure 7:
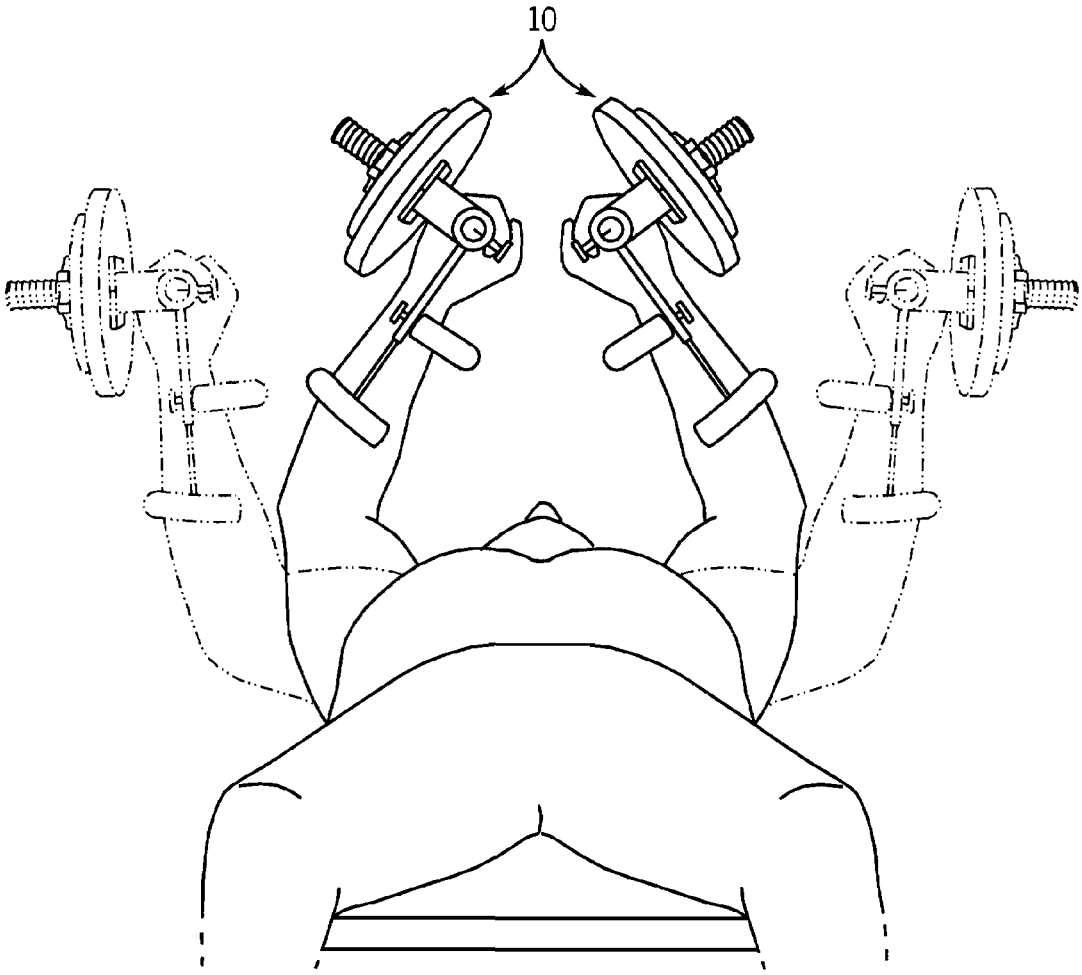
FIG. 7 is a front view of a pair of exercise devices applied to the forearms of an exerciser performing chest flyes.

Before applying the device 10 on one's forearm, one or more weight plates 30 can be secured on the bar 28 and the locking arrangements 20, 22 can be set to position the desired angular relationship of the second framework 14 relative to the first framework 12 as well as to establish the preferred spacing between the forearm braces 16, 18. Referring now to FIG. 5, the user's forearm is simply passed between the braces 16, 18 so that brace 16 engages the top of the forearm and brace 18 engages the bottom of the forearm. The user's hand is grasped around the handgrip 40 and the device 40 is ready for use. FIG. 5 illustrates the device 10 being employed during a biceps curl with FIG. 6 depicting the use of two exercise devices 10 installed on both forearms of the user during a seated curl. In such illustration, the angle of the longitudinal axis of the bar 28 is slightly offset at a small angle relative to the longitudinal axes of the tubular members 42, 44. The exercise device 10 continues to apply useful resistance to the biceps throughout a full range of movement as the weight load is constantly extended beyond the handgrip 40. Otherwise stated, the normal lever arm between the user's elbow and the hand is increased so as to better stimulate the muscle(s) being exercised. The device 10 thus prevents the weight load from falling forward toward the user at the top of the bicep curl as is the case when exercising with a conventional dumbbell or barbell. The braces 16, 18 maintain the stability of the device 10 throughout the chosen exercise. The exercise device 10 may be used in various other upper body exercises, such as in dumbbell flyes as represented in FIG. 7. In this case, the angular positioning of the device 10 is similar to that shown in full lines of FIG. 2 so that constant resistance can be applied to the pectoral muscles particularly at the top of the exercise.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. In a forearm-mounted exercise device having a framework provided with a weight supporting bar and a handgrip on a first portion of the framework, and a pair of spaced apart forearm braces on a second portion of the framework, the improvement comprising:

rotary adjustment means incorporated in the framework for enabling variable rotational positioning between the first portion of the framework and the second portion of the framework, wherein the second portion of the framework is rotatable mounted on the handgrip, and wherein a rotary locking arrangement is engageable on the handgrip for selectively locking and unlocking the first and second portions of the framework in various angular positions on the handgrip.

2. In a forearm-mounted device having a framework provided with a weight supporting bar and a handgrip on a first portion of the framework, and a pair of spaced apart forearm braces on a second portion of the framework, the improvement comprising:

forearm brace adjustment means disposed on the framework for changing the spacing between the forearm braces on the second portion of the framework, and a rotary locking arrangement engageable on the handgrip for selectively locking and unlocking the first and second portions of the framework in various angular positions on the handgrip, wherein the distance between the weight supporting bar and the handgrip is fixed.

3. The improvement of claim 2, wherein the second portion of the framework includes a first pair of elongated, parallel first tubular members rotatably secured to the handgrip for carrying one of the forearm braces, and the second pair of elongated, parallel tubular members slidably received within the first pair of tubular members for mounting the other of the forearm braces.

4. The improvement of claim 3, including a locking arrangement on the first pair of tubular members for selectively locking and unlocking the second pair of tubular members in various linear positions relative to the first pair of tubular members.

5. An exercise device adapted to be supportively fixed over a user's forearm and gripped by a hand thereon for mounting at least one weight plate outward of the hand to maintain the resistance applied by the weight plate over a full range of different exercises, the device comprising:

a first framework having one end provided with a weight receiving and supporting bar, and an opposite end mounting a handgrip thereon;

a second framework pivotally secured to the handgrip;

a first brace joined to the second framework and adapted to engage a top surface of the user's forearm;

a second brace connected to the second framework in spaced relationship to the first brace and adapted to engage a bottom surface of the user's forearm; and a locking arrangement located between the first framework and the second framework for selectively locking and unlocking the first framework and the second framework together in various relative angular positions on the handgrip, wherein the second framework is constructed and arranged such that the spacing between the first brace and the second brace is adjustable.

6. The exercise device of claim 5, wherein the first framework includes a support base having a forward surface mounting the weight receiving and supporting bar therefrom, and a rearward surface connected to a pair of rearwardly extending, spaced apart, support arms engaged with respective opposite ends of the handgrip such that the opposite ends of the handgrip extend laterally from the support arms.

7. The exercise device of claim 6, wherein the weight receiving and supporting bar projects outwardly from the forward surface of the support base in substantially perpendicular relationship thereto.

8. The exercise device of claim 6, wherein the second framework includes a first pair of elongated, parallel tubular members having first ends rotatably mounted to the laterally extending opposite ends of the handgrip, and open second ends, the first brace being fixed to the first tubular members adjacent the second ends thereof.

9. The exercise device of claim 8, wherein the first ends of the first pair of tubular members are provided with ringed collars rotatably engaged with cylindrical portions on the opposite ends of the handgrip.

10. The exercise device of claim 9, wherein the opposite ends of the handgrip are provided with indicators and the ringed collars are provided with indicia cooperable with the indicators for indicating relative angular positions of the first and second frameworks relative to one another.

11. The exercise device of claim 8, wherein the second framework also includes a second pair of elongated, parallel tubular members having first ends slidably received in the open second ends of the first pair of tubular members and second ends connected to the second brace.

12. The exercise device of claim 9, wherein the locking arrangement includes a pair of locking screws screwthreaded into the ringed collars and engaged against the opposite ends of the handgrip.

13. The exercise device of claim 11, including another locking arrangement located on the first tubular members adjacent the second ends thereof for selectively locking and unlocking the second pair of tubular members at various linear positions relative to the first pair of tubular members.

14. The exercise device of claim 11, wherein the another locking arrangement includes another pair of locking screws screwthreaded into the first pair of tubular members for engagement against the second pair of tubular members.

15. The exercise device of claim 11, wherein the second framework is rotationally adjustable relative to the first framework between a first angle at which longitudinal axes of the second tubular members are perpendicular to a longitudinal axis of the weight receiving and supporting bar, and a second angle at which the longitudinal axes of the second tubular members are parallel to the longitudinal axis of weight receiving and supporting bar.

16. An exercise device adapted to be supportively fitted over a user's forearm and gripped by a hand thereon for mounting at least one weight plate outward of the hand to maintain the resistance applied by the weight plate during various exercises, the device comprising:

a fixed framework having one end provided with a weight receiving and supporting spindle, and an opposite end mounting a handgrip thereon;

a telescopic framework pivotally secured to the handgrip and including a first pair of elongated, spaced apart tubular members having first ends rotatably mounted to opposite ends of the handgrip, and open second ends, the telescopic framework also including a second pair of elongated, spaced apart tubular members having first ends slidably received in the open second ends of the first pair of tubular members, and second ends projecting in a direction away from the handgrip;

a first brace joined to the first pair of tubular members adjacent the second ends thereof and adapted to engage a top surface of the user's forearm;

a second brace fixed to the second pair of tubular members adjacent the second ends thereof and adapted to engage a bottom surface of the user's forearm;

a first locking arrangement located on the first ends of the first pair of tubular members for selectively locking and unlocking the first and second pairs of tubular members at various angular positions on the handgrip; and a second locking arrangement positioned on the first pair of tubular members adjacent the second ends thereof for selectively locking and unlocking the second pair of tubular members in various linear positions longitudinally relative to the first pair of tubular members so that the first brace and the second brace are variably spaced from one another.

17. The exercise device of claim 16, wherein the distance between the weight receiving and supporting spindle and the handgrip is fixed.

* * * * *